United States Patent [19]

Binns

[11] 3,966,502

[45] June 29, 1976

[54] ZIRCONIUM RINSE FOR PHOSPHATE COATED METAL SURFACES

[75] Inventor: Robert Eric Binns, Abington, Pa.

[73] Assignee: Amchem Products, Inc., Ambler, Pa.

[22] Filed: Sept. 6, 1974

[21] Appl. No.: 504,005

Related U.S. Application Data

[60] Division of Ser. No. 281,357, Aug. 17, 1972, Pat. No. 3,850,732, which is a continuation-in-part of Ser. No. 94,531, Dec. 2, 1970, Pat. No. 3,695,942.

[52] U.S. Cl. ..... 148/6; 148/6.14 R; 148/6.15 R; 148/6.15 Z; 106/14; 106/299

[51] Int. Cl.[2] ..... C23F 7/10

[58] Field of Search ..... 106/299, 14; 204/64 T; 148/6.15 R, 6.15 Z, 6.14 R, 6; 428/275

[56] References Cited

UNITED STATES PATENTS

| | | | |
|---|---|---|---|
| 1,536,254 | 5/1925 | White | 428/275 |
| 2,017,125 | 10/1935 | Kinzie | 106/299 |
| 2,316,057 | 4/1943 | Doser et al. | 428/275 |
| 2,323,387 | 7/1943 | Edelstein | 428/275 |
| 2,328,431 | 8/1943 | Doser et al. | 428/275 |
| 3,539,402 | 11/1970 | Ries | 148/6.14 R |
| 3,695,942 | 10/1972 | Binns | 148/6.15 R |
| 3,850,732 | 11/1974 | Binns | 204/181 |

*Primary Examiner*—Ralph S. Kendall
*Attorney, Agent, or Firm*—Ernest G. Szoke; Michael E. Zall

[57] ABSTRACT

A metal surface upon which a conversion coating has already been formed, is treated by contacting the surface with an aqueous solution consisting of a soluble zirconium containing compound, thereby improving the qualities of the conversion coating.

3 Claims, No Drawings

ZIRCONIUM RINSE FOR PHOSPHATE COATED METAL SURFACES

This is a division of application Ser. No. 281,357, filed Aug. 17, 1972, now U.S. Pat. No. 3,850,732 which is a continuation-in-part of application Ser. No, 94,531, filed Dec. 2, 1970 now U.S. Pat. NO. 3,695,942.

It is common practice in the art to improve the qualities of the protective metal coating, commonly referred to as a conversion coating, by subsequently treating the metal surface after the conversion coating has been formed thereon. This treatment is usually affected by a final rinsing step, whose purpose is to enhance the corrosion resistance of the metal surface. In addition, the rinsing treatment is employed to prepare the surface for the reception of a final finish coating such as a paint, enamel, japan, or the like.

The final rinsing step is commonly effected in the art employing chromic acid and salts thereof, as the essential ingredient of the rinsing solution. Chromate final rinses employed after a phosphate conversion coating has been formed on a metal surface are disclosed, for example, in U.S. Pat. Nos. 3,063,877; 3,104,177; and 3,450,579.

An important shortcoming, which rinses of the kind to which reference has been made possess, is the inherent toxicity of the hexavalent and trivalent chromium compounds contained therein and the resultant waste disposal problem created by the presence of hexavalent chromium or trivalent chromium in the effluent.

Another problem with chromium containing final rinses is that certain paint systems will chip, peel, or blister when applied to a surface which has been rinsed with chromate solution. Workpieces having complex configurations will accumulate residues of chromium salts in areas such as crevices, pockets and joints. These areas, upon painting, will tend to display blistering, peeling, and generally inferior paint adhesion.

Chromium final rinses also cause staining problems. For example, yellow staining is frequently encountered in the final paint film where a chrome rinse was employed under a thin siccative film.

The present invention eliminates the water effluent problem in present day final rinses by providing a suitable chromium-free treatment. The blistering and staining problems, encountered when siccative coatings are applied subsequent to chromium rinses, are also alleviated with the practice of this invention.

The principal object of this invention is to provide a final rinse material which is particularly non-toxic and which improves the corrosion resistance of a metal surface on which a conversion coating has already been formed.

Another object of this invention is to provide a non-chromium final rinse solution for metal surfaces, thereby eliminating the important waste disposal problem inherent in present day rinse treatments.

A concomitant object of this invention is to provide an improved method for rinsing metal surfaces on which a conversion coating has already been deposited.

An added object of this invention is to provide a process and treating solution for metal surfaces which will greatly enhance the properties of subsequently applied siccative finishes thereon, the improved properties thus extending the life of such later applied siccative finish when subjected to corrosive atmospheres.

Further objects of this invention will be apparent in the detailed description which follows.

I have discovered a chrome-free final rinse process and solutions for treating the surfaces of metals such as iron, steel, zinc, aluminum, and alloys in which they are the predominant constituent. The present invention enhances the corrosion resistant properties of a conversion coating which has been formed on the surface. The process of the present invention employs an aqueous zirconium rinse solution consisting essentially of a soluble zirconium compound which provides the improved qualities to the conversion coat.

It should be understood that by "zirconium rinse solution" or "zirconium rinse composition", I mean any aqueous zirconium solution used in accordance with the method of this invention. The concentration of zirconium present in the rinse solutions of this invention is expressed herein as the concentration of $ZrO_2$. This means that the zirconium, present as a soluble zirconium compound in the solution, is in the form of tetravalent zirconium whose concentration is expressed as the concentration of its oxide.

The aqueous rinse solution of the present invention consists essentially of at least 0.05 grams/liter of soluble zirconium, the zirconium present as a water-soluble zirconium compound and expressed as $ZrO_2$ in solution.

A wide variety of soluble zirconium compounds can be employed in the practice of the present invention. The selection of the compound to be employed will depend on its commercial availability and its stability in solution at the operating pH of the rinse process. It is incumbent upon the particular zirconium compound employed, that it does not hydrolyze to insoluble hydrous zirconium dioxide or an insoluble zirconyl salt when in solution at the operating pH of the process. Such hydrolysis would cause the precipitation of zirconium from solution. When precipitation occurs, the concentration of the necessary zirconium in solution is dimished, thereby reducing the amount of zirconium available to treat or rinse the conversion coating, resulting in a deterioration of the effectiveness of the solution.

Typical examples of solutions which can be employed in the process of the present invention are aqueous solutions comprised of soluble zirconium compounds selected from the group consisting of alkali metal and ammonium fluozirconates, zirconium carboxylates, and alkali metal and ammonium salts of zirconium hydroxy carboxylates. Examples of zirconium carboxylates which have given excellent results are zirconium acetate and zirconium oxalate.

The zirconium hydroxy caboxylates are difficultly soluble in water, but their alkali and ammonium salts are readily water-soluble. Examples of ammonium zirconium hydroxy carboxylates which can be employed in the process of the present invention are ammonium zirconium glycolate, ammonium zirconium lactate, ammonium zirconium mandelate, ammonium zirconium citrate, ammonium zirconium gluconate, and ammonium zirconium tartrate.

An aqueous rinse solution comprised of a soluble complex salt of zirconium has also been found to be effective when utilized in the process of the present invention. A typical example of these complex zirconium salts is zirconium ethylendiamine tetraacetate.

Prior to treatment with the aqueous rinse solution, the metal surface will have been treated with a solution which reacts with the surface to form what is known in the art as a conversion coating. The conversion coating will have been applied using commonly employed processes and techniques known to the art. Particularly, the conversion coatings employed prior to the process of the present invention are those referred to as phosphate coatings. By phosphate coatings, I mean the crystalline zinc phosphate coatings produced from aqueous baths containing primary zinc phosphate with phosphoric acid, and the iron phosphate coatings produced from aqueous baths containing alkali metal or ammonium acid phosphates. The iron phosphate coatings can be employed over iron, steel, or alloys thereof, and the zinc phosphate coatings can be applied on iron, steel, zinc, aluminum, or alloys thereof. Examples of commonly practiced zinc phosphate and iron phosphate coating processes and compositions can be found in U.S. Pat. Nos. 3,333,988; 3,297,494; 3,425,876; 3,520,737; 3,101,286; 2,987,428 and 3,129,123.

Formula 1 is an example of a suitable concentrated zinc phosphate coating solution which can be diluted to desired strength with water and can be employed to treat iron, steel, aluminum, and zinc surfaces prior to their treatment with the rinse process of the present invention.

FORMULA 1

| | Percent by weight |
|---|---|
| Zinc oxide | 11.01 |
| Nickel oxide | 2.65 |
| 75% phosphoric acid | 35.33 |
| 38°Be nitric acid | 12.50 |
| 70% hydrofluoric acid | 1.28 |
| Ferrous phosphate | .67 |
| 49% fluoboric acid | 3.18 |
| Water | 33.38 |

Formula 2 is an example of a suitable concentrated alkali metal acid phosphate coating solution which can be diluted to desired strength with water and can be employed to treat iron and steel forming an iron phosphate coating thereon prior to treatment with the rinse process of the present invention.

FORMULA 2

| | Percent by weight |
|---|---|
| Phosphoric acid (75% solution) | 26.88 |
| Soda ash | 8.08 |
| Sodium chlorate | 11.22 |
| Water | 53.82 |

The coating process will ordinarily include a prior cleaning step, intervening rinsing steps, an activating step, and the conversion coating application.

The cleaning step, which forms no part of the present invention, is necessary to insure complete physical contact of the subsequently applied coating solution with the metal surface and to remove any grease and soil films that are on the metal surface. This cleaning and degreasing process, usually effected by spraying, can be accomplished with known alkaline cleaning agents. After the surface has been effectively cleaned, it will require at least one water rinse to completely remove the cleaner from the metal surface. The water rinse can be followed by an activating treatment before the conversion coating is deposited on the metal surface.

In the coating operation, the workpiece is brought into contact with the aqueous coating solution under suitable conditions of temperature, pH and contact time. Contact is effected by either spraying, immersion techniques, roller coating, or brushing to produce the desired surface conversion coating. Subsequent to the formation of said conversion coating, the process of the present invention is utilized.

The present invention can be effected with or without an intervening water rinse between the prior conversion coating application and the aftertreatment prescribed herein. An intervening rinse is employed when it is desired to remove any adhering ingredients on the surface carried over from the coating bath, which may cause subsequent corrision or paint blistering should they remain thereon.

The rinse solution employed in the process of the present invention should be operated at a pH above 3.0. Preferably, the rinse process should be effected with a solution having a pH of from about 4.0 to about 8.5. The pH of the rinse solution should not be allowed to fall below 3.0 since the conversion phosphate coating which has been applied on the surface will be attacked and partially dissolved by a solutin whose pH is below 3.0 and the rinse will not be as effective in preparing the surface for the siccative finish to be applied. In general, the pH of a rinse solution which is prepared according to the invention will automatically end up within the pH range of about 3.0 to 8.5. Should the pH of the rinse solution fall below the critical limit of 3.0, the solution pH can be raised by addition of alkali. Should it be desired to raise the pH to a particular value within the range of 3.0 to 8.5, then alkali can be added. Suitable alkalis are the alkali metal hydroxides, with ammonium hydroxide being preferred. The addition of a suitable alkali in an amount sufficient to adjust the pH of the rinse solution to a desired or preferred level will not interfere with the effectiveness of the present process.

The operating limits of the present process require that the zirconium compounds utilized herein should be those which will not hydrolyze when the solutin pH is above 3.0. When the soluble zirconium compound that is available will hydrolyze when added to water, at a solution pH above 3.0, its use should be avoided.

The rinse solutions employed in this invention are generally made up as aqueous solutions and preferably contain from about .05 grams/liter to about 3 grams/liter of zirconium, expressed as $ZrO_2$ and present in the form of a water-soluble zirconium compound. In the preferred practice of the present invention, zirconium acetate is employed as the water-soluble zirconium compound. Optimum results have been obtained wherein there is from about 0.2 grams/liter to about 0.4 grams/liter of zirconium, expressed as $ZrO_2$, in a zirconium acetate rinse solution.

The recommended method for preparing the rinse solution comprises the aqueous dilution of an aqueous concentrate solution, said concentrate comprising water and the soluble zirconium compound. The maximum amounts of the zirconium compound which can be present in the concentrate is limited only by the solubility of the material employed as the source for the zirconium. Alternatively, a dry commercially available zirconium compound can be dissolved in a measured amount of water producing the zirconium rinse solution having a zirconium concentration within the limits specified herein.

The rinse solution and the aqueous concentrated solution employed to make up the zirconium rinse solution can be comprised of the zirconium constituent and preferably distilled or deionized water. Tap water or a commercial water supply almost invariably includes undesirable mineral agents. It is desirable to avoid the presence of materials in the rinse solution which will leave deposits or corrosive residues. The use of deionized water in the rinse solution leaves no interfering residues deposited on the surface.

It has been found that the interference caused by the undesirable mineral agents can be avoided by addition to the aqueous concentrate solution, comprising water and the soluble zirconium compound, of a stabilizing agent such as, for example, gluconic acid or citric acid or salts thereof. The addition of the stabilizing agent causes the rinse solution to be more resistant to the harmful effects of the undesirable mineral agents and alkaline impurities. Once the rinse solution has been stabilized to prevent both hydrolysis of the zirconium compound and the deposition of corrosive residues, the rinse solution can be comprised of the zirconium compound and water having mineral agents and alkaline earth metals present in amounts as high as 400 ppm, thereby allowing most commercial water supplies to be employed in preparing the zirconium rinse solutions.

It appears that the improved stability and results obtained by the addition of the stabilizing agent to the zirconium rinse solution results from the formation of complexes in the solution, thereby allowing the zirconium to be more resistant to hydrolysis and also to prevent the deposition of corrosive residues. It should be recognized that an amount of stabilizing agent should be employed which will result in the formation of these complexes in solution without any detrimental effect to the desired corrosion resistance results obtained. For best results, the stabilizing agent should be present in an amount such that for each part by weight of zirconium measured as $ZrO_2$, there is at least 0.5 parts by weight of stabilizing agent in the rinse solution.

It is within the scope of this invention to employ a wetting agent in the improved rinse solution, in order to improve the contact between the metal surface and rinse solution. Any organic wetting agent which is sufficiently soluble and stable at the operating pH of the solution can be employed. Typical examples of wetting agents which will improve the ability of the rinse solution to thoroughly wet the metal surface are sodium alkyl sulfonates, and sulfonated hydrocarbons, such as alkylated naphthalene sulfonic acids.

The rinse process can be effected by employing any of the contacting techniques known to the art. Preferably, the rinse solution will be applied to the metal surface by conventional spray or immersion methods.

The time of treatment of the metal surface with the final rinse solution need only be long enough to ensure complete wetting of the surface and can be as long as 5 minutes. Preferably, the surface should be immersed, sprayed, or flowcoated for a rinse time about 15 seconds to about 1 minute.

The rinse solution can be operated at temperatures as high as 200°F. It is preferred that the process of the present invention be operated at ambient temperatures, that is from about 65° F to about 95° F.

Subsequent to the final rinse treatment, the metal surface is usually dried. This can be accomplished by conventional techniques such as passing the metal surface through a heated oven, subjecting it to a warm air stream, or by just allowing it to dry on its own at room temperature. If speed is a necessary factor, such as when the surface is to be painted immediately following the rinse treatment, any forced method of drying the rinsed surface can be accomplished. In some instances, the metal surface can be rinsed with water following the treatment with the zirconium rinse solution and prior to the deposition of a siccative finish thereon with a resulting improvement in corrosion resistance.

A siccative finish can be deposited on the metal surface subsequent to treatment with the process of the present invention. The application of such a finish, such as paint or lacquer, can be accomplished by well known methods in the art which form no part of the present invention.

An important aspect of the present invention is the improved corrosion resistance portrayed by a metal surface on which an electrophoretically deposited paint finish has been applied subsequent to treatment with the process of this invention. I have found that a metal surface which is treated with a phosphate coating solution, rinsed with a zirconium rinse solution of the present invention, followed by a water rinse, and then electropainted, possesses superior corrosion resistance to a surface which is electropainted without undergoing a rinse treatment with a solution of the present invention.

The following examples are illustrative of this invention and are not considered as limiting for other materials and operating conditions falling within the scope of this invention that might be substituted. Examples 1 through 6 are set forth for the purpose of illustrating the preparation of aqueous concentrates and rinse solutions within the purview of the invention. Examples 7 through 14 illustrate the improved results obtained employing the process of the present invention.

EXAMPLE 1

A 1 liter sample of an aqueous concentrate was prepared by adding 110.8 grams of anhydrous diammonium citrate to 600 grams of a commercially available aqueous ammonium zirconyl carbonate solution comprising 10% by weight of zirconium, measured as $ZrO_2$. The aqueous mix was heated to 140°F with continuous stirring. Heating and agitation was continued until the evolution of $CO_2$ had ceased. An ammonium zirconium citrate concentrated solution was formed having a zirconium concentration of 60 grams/liter measured as $ZrO_2$. The aqueous concentrated solution was then added to water, at a rate of 5 ml. of concentrate per liter of water, to produce a zirconium rinse solution consisting of ammonium zirconium citrate having a zirconium concentration of 0.3 grams/liter, measured as $ZrO_2$. The pH of this zirconium rinse solution was measured at 5.9.

EXAMPLE 2

A 1 liter aqueous concentrate was prepared by dissolving 81.2 grams of commercially available dry zirconium glycolate in 500 ml. of 1 molar ammonium hydroxide solution at ambient temperature. Water was added so that the total volume of the concentrated solution was 1 liter. A diammonium zirconium glycolate concentrated solution had been formed with a zirconium concentration of 30 grams/liter, measured as $ZrO_2$. The aqueous concentrate was added to water, at the rate of 10 ml. per liter of water, producing an aqueous zirconium rinse solution consisting of ammonium zirconium glycolate having a zirconium concentration of 0.3 grams/liter, measured as $ZrO_2$. The pH of this zirconium rinse solution was measured at 4.9.

EXAMPLE 3

A 1 liter aqueous zirconium rinse solution was prepared by dissolving 0.59 grams of commercially available dry ammonium zirconium fluoride in 1 liter of water at ambient temperature. The rinse solution was ready for use having a zirconium concentration of 0.3 grams/liter, expressed as $ZrO_2$. The pH of this zirconium rinse solution was measured at 4.0.

EXAMPLE 4

A 1 liter sample of an aqueous concentrate was prepared by adding 423.6 grams of commercially available carbonated hydrous zirconia to 485 ml. of 5 Molar acetic acid at ambient temperature. The aqueous mix was continuously agitated until the evolution of $CO_2$ had ceased. Water was added to make 1 liter of concentrated solution, having a zirconium concentration of 150 grams/liter, measured as $ZrO_2$.

The aqueous concentrate was added to water at a rate of 1 ml. of concentrate per liter or water, to form a zirconium rinse solution consisting essentially of zirconium acetate, having a zirconium concentration therein of 0.15 grams/liter, expressed as $ZrO_2$. The pH of this zirconium rinse solution was measured at 4.6.

EXAMPLE 5

One liter of an aqueous concentrate was prepared by adding 318.6 grams of a commercially available gluconate solution consisting of partially neutralized gluconic acid in the form of sodium gluconate and having a gluconic acid equivalent of 50% by weight to 455 grams of commercially available aqueous zirconium acetate solution comprising 22% by weight of zirconium, measured as $ZrO_2$. Water having undesirable mineral agents, such as calcium and magnesium salts, in an amount above 300 ppm was then added to make 1 liter of concentrated solution having a zirconium concentration of 100 grams/liter, measured as $ZrO_2$. The aqueous concentrate was added to tap water having undesirable mineral agents such as calcium and magnesium salts, in an amount above 300 ppm, at a rate of 3 mls. of concentrate per liter of water, to form a zirconium rinse solution having a zirconium concentration of 0.3 grams/liter, expressed as $ZrO_2$. The pH of the zirconium rinse solution was 5.5.

EXAMPLE 6

An aqueous concentrate was prepared by adding 200 mls. of an aqueous diaamonium citrate solution consisting of 69% by weight of the citrate salt, to 681.8 grams of commercially available aqueous zirconium acetate solution comprising 22% by weight of zirconium, measured $ZrO_2$. The mixture was heated at 140° F for 30 minutes wit agitation. Tap water having undesirable mineral agents, such as calcium and magnesium salts, in an amount above 300 ppm, was added to make 1 liter of concentrated solution having a zirconium concentration of 150 grams/liter, measured as $ZrO_2$. The aqueous concentrate was added to tap water at a rate of 2 mls. of concentrate per liter of water, to form a zirconium rinse solution having a zirconium concentration of 0.3 gram/liter, measured as $ZrO_2$. The pH of the rinse solution was measured at 5.9.

EXAMPLE 7

Four inches by six inches cold rolled steel test panels were employed in this procedure. The panels were cleaned, rinsed with water and then subjected to a conventional prepaint processing sequence which provided a zinc phosphate conversion coating on their surfaces.

One set of control panels was then rinsed with deionized water, and another set of control panels was rinsed with a commonly employed chromic acid solution with a hexavalent chromium concentration of 0.3 grams/liter (measured as $CrO_3$) at a pH of 3.5. A third set of panels was rinsed with an aqueous ammonium zirconyl carbonate solution having a zirconium concentration of 0.2 grams per liter, measured as $ZrO_2$.

The treated panels were immersed in the zirconium rinse solution for 1 minute at room temperature, allowed to air dry, and were oven baked for 5 minutes. The pH of the zirconium rinse solution was recorded at 8.3.

All test panels, i.e. those treated with the zirconium rinse solution, as well as the control panels that were rinsed with deionized water or chromic acid, were then painted with two coats of an asphaltum based baking enamel, and the painted surfaces were cured at 450°F for 45 minutes.

The painted panels were scribed diagonally so that base metal was exposed. The panels were the subjected to a 5% salt fog test at 35°C conducted in accordance with ASTMB-117.

After a 168 hour exposure period, the panels were rated in accordance with ASTMD 1654-61, by inspecting the paint loss and measuring the average failure of the paint film from the scribe. The corrosion failure results are listed in Table 7. The results of the salt fog test in Table 7 are the averages of results of four tests. The performances of the zirconium rinsed panels was better than the controls rinsed with deionized water and were equal to the results obtained by the panels treated with the chromic acid solution.

TABLe 7

| Final Rinse Treatment | pH | Average Scribe Failure in Inches |
|---|---|---|
| Control — DI water rinse and no further treatment | 6.0 | 4/32 |
| Control — Chromic Acid Rinse | 3.5 | 2/32 |
| Ammonium Zirconyl Carbonate | 8.3 | 2/32 |

EXAMPLE 8

Cold rolled steel and galvanized steel test panels were employed in this procedure. The panels were cleaned, rinsed with water, and coated with a conventional zinc phosphate conversion coating.

One set of control panels was treated with a deionized water rinse and another set of control panels was rinsed with a commercially available chromic acid final rinse with hexavalent chromium concentration of 0.28 grams/liter (measured as $CrO_3$) at a pH of 3.5. A third set of test panels was aftertreated with a zirconium acetate rinse solution.

The zirconium concentrated solution, as prepared in Example 4, was added to water at a rate of 2 ml. per liter of water to form the zirconium rinse solution consisting of 0.6 grams/liter of zirconium acetate. The concentration of zirconium in the rinse solution was 0.3 grams/liter (measured as $ZrO_2$). The pH of the rinse solution was recorded at 4.6 with no pH adjustments required during use of the solution. The test panels were treated by spraying the respective rinse solutions onto the test panel surfaces as a conveyor moved the panels through a power spray chamber. All the rinse baths, i.e. the deionized water rinse, the chromic acid rinse, and the zirconium acetate rinse, were operated at room temperature. The rinse spray was allowed to contact the panel surface for no more than 20 seconds. The panels were dried by passing them through an oven for one minute at 200°F.

All the test panels were then painted with a one coat gloss acrylic paint system. The painted surfaces were cured at 350°F. for 30 minutes. The painted panels were scribed diagonally so that base metal was exposed. The panels were then subjected to a 5% salt fog corrosion test at 35°C, conducted in accordance with ASTMB-117.

Following a 312 hour exposure period to the salt fog corrosion test, the panels were examined for corrosion failure, and rated in accordance with ASTMD 1654-61 by measuring the average paint failure from the scribe. The results are illustrated in Table 8. The results of the salt fog tests in Table 8 are the averages of results of four tests. The test panels which were rinsed with the deionized water showed vast areas of corrosion and scribe failure compared to those panels which were rinsed with the zirconium acetate rinse solution. The panels rinsed with the zirconium acetate solution possessed corrosion resistant properties and scribe failure equal to the control panels rinsed with the chromic acid solution.

Table 8

| Final Treatment | Average Scribe Failure in Inches | |
|---|---|---|
| | Galvanized Panels | Steel Panels |
| Deionized Water Rinse — Control | 12/32 | 4/32 |
| Chromic Acid Rinse Solution | 2/32 | traces |
| Zirconium Acetate Rinse Solution | 2/32 | traces |

EXAMPLE 9

Four inches by six inches cold rolled steel panels were employed in this procedure. The test panels were cleaned, rinsed with water, and were then coated in an alkali metal acid phosphate coating bath producing on their surface an adherent conversion coating of iron phosphate.

One set of control panels received a deionized water rinse and another set of control panels was rinsed in a chromic acid solution having a hexavalent chromium concentration of 0.28 grams/liter (measured as $CrO_3$) at a pH of 3.5. A third set of test panels was aftertreated with an aqueous rinse solution consisting of 0.6 grams/liter of zirconium acetate so as to impart a concentration of 0.3 grams/liter of zirconium in the solution (measured as $ZrO_2$). The pH of the zirconium rinse solution was measured at 4.6. The panels were aftertreated with the deionized water, chromic acid rinse, and zirconium rinse, by immersing them into the respective rinse solution for 30 seconds at room temperature. The panels were then dried in an oven for five minutes at 300°F.

The panels were painted with a two coat asphaltum-based baking enamel. The painted surfaces were cured at 450°F for 45 minutes. The painted panels were scribed diagonally so that base metal was exposed.

The test panels were then subjected to a 5% salt fog corrosion test at 35°C, conducted in accordance with ASTMB-117. Fillowing 96 hours of salt fog exposure testing, the panels were examined for corrosion failure. The panels were rated in accordance with ASTMD 1654-61 by measuring the average failure of the paint film from the scribe. The results are shown in Table 9. Those panels treated with the zirconium final rinse displayed superior corrosion resistance compared to both the deionized water rinsed and the chromic acid rinsed panels. The results in Table 9 are the averages of results of four tests.

TABLE 9

| Final Treatment | Average Scribe Failure in Inches |
|---|---|
| Deionizod Water | 7/32 |
| Chromic Acid Solution | 7/32 |
| Zirconium Acetate Rinse Solution | 1/32 |

EXAMPLE 10

Four inches by six inches rolled steel panels were employed in this procedure. The test panels were cleaned, rinsed with water, and were then coated in an alkali metal acid phosphate coating bath producing on their surface an adherent conversion coating of iron phosphate.

One set of control panels received a deionized water rinse and another set of control panels was rinsed in a chromic acid solution having a hexavalent chromium concentration of 0.28 grams/liter (measured as $CrO_3$) at a pH of 3.5. A third set of test panels was aftertreated with an aqueous rinse solution consisting of 0.6 grams/liter of zirconium acetate so as to impart a concentration of 0.3 grams/liter of zirconium in the solution (measured as $ZrO_2$). The pH of the zirconium rinse solution was measured at 4.6.

The panels were aftertreated with the deionized water, chromic acid rinse, and zirconium rinse, by immersing them into the respective rinse solution for 30 seconds at room temperature. The panels were then dried in a oven for 5 minutes at 300°F.

The panels were then painted with a one coat gloss alkyd paint system. The painted surfaces were cured at 350°F for 30 minutes. The painted panels were scribed diagonally so that base metal was exposed.

The test panels were then subjected to a 5% salt fog corrosion test at 35°C, conducted in accordance with ASTMB-117. Following 96 hours of salt fog exposure testing, the panels were examined for corrosion failure. The panels were rated in accordance with ASTMD 1654-61 by measuring the average failure of the paint film from the scribe. The results are shown in Table 10. The results of the salt fog tests in Table 10 are the averages of results of four tests. Those panels treated with the zirconium final rinse displayed superior corrosion resistance compared to both the deionized water rinsed panels and the chromic acid rinsed panels.

TABLE 10

| Final Rinse Treatment | Average Scribe Failure in Inches |
|---|---|
| Deionized Water | 18/32 |
| Chromic Acid Solution | 6/32 |

TABLE 10-continued

| Final Rinse Treatment | Average Scribe Failure in Inches |
|---|---|
| Zirconium Acetate Solution | 1/32 |

EXAMPLE 11

Cold rolled steel panels were employed in this procedure. The panels were cleaned, rinsed with water, and were then treated with a zinc phosphate conversion coating solution. The panels were then treated with rinse solutions falling within the scope of this invention. Particularly, ammonium zirconium glycolate, ammonium zirconium lactate, and ammonium zirconium mandelate were employed in this procedure. One set of control panels was rinsed with deionized water and another set was treated with a chromic acid rinse solution with a concentration of hexavalent chromium of 0.23 grams/liter (measured as $CrO_3$) at a pH of 3.5. The zirconium rinse solutions employed in this procedure wre prepared so that each rinse solution consisted of 0.3 grams/liter of zirconium (measured as $ZrO_2$).

The panels were immersed in the respective rinse solutions for 30 seconds at room temperature, and were oven baked for 5 minutes at 300°F. The rinse solution pH was recorded as indicated in Table 11.

The panels treated with the zirconium rinse solutions, as well as the control panels which were rinsed with deionized water or chromic acid solution, were then painted with a two coat asphaltum-based baking enamel. The painted surfaces wre cured at 450°F. for 45 minutes. The painted panels were scribed diagonally so that base metal was exposed. The panels were then subjected to 5% salt fog corrosion testing at 35°C, conducted in accordance with ASTMB-117.

The panels were rated in accordance with ASTMD-1654-61 by measuring the average failure of the paint film from the scribe and recording this failure in inches. The corrosion test results, as indicated in Table 11, showed those panels which had been rinsed with the rinse solutions of the present invention to be superior in corrosion resistance to the panels rinsed with deionized water or chromic acid solution. The salt fog test results in Table 11 are the averages of results of four tests.

TABLE 11

| Final Rinse Treatment | pH | Average Scribe Failure in Inches |
|---|---|---|
| Control — Deionized Water | 6.0 | 2/32 |
| Control — Chromic Acid Solution | 3.5 | 1/32 |
| Ammonium Zirconium Glycolate | 5.7 | 1/64 |
| Ammonium Zirconium Lactate | 5.3 | 1/64 |
| Ammonium Zirconium Mandelate | 6.5 | 1/64 |

EXAMPLE 12

Four inches by six inches cold rolled steel panels were employed in this procedure. The panels were cleaned, rinsed with water, and treated with a zinc phosphate coating solution and possessed upon their surfaces a zinc phosphate conversion coating. The panels were then treated with rinse solutions falling within the scope of this invention. Particularly, ammonium zirconium citrate, ammonium zirconium tartrate, zirconium ethylenediamine tetraacetate, and ammonium zirconium gluconate were employed in this procedure. One set of control panels was rinsed with a chromic acid solution, and another set of control panels was rinsed with deionized water.

The zirconium rinse solutions were prepared so that there was 0.3 grams/liter of zirconium (measured as $ZrO_2$) in said rinse solutions. The pH of the respective rinse solutions was recorded and is indicated in Table 12. The test panels were immersed in the rinse solutions for a period of 30 seconds at room temperature, allowed to air dry, and then were oven baked for five minutes at 300°F.

The panels treated with the zirconium rinse solutions, as well as the control panels that were rinsed with deionized water or chromic acid solution, were then painted with a two coat asphaltum-based baking enamel. The painted surfaces were cured at 450°F for 45 minutes. The painted panels were scribed diagonally so that base metal was exposed.

The panels were then subjected to 5% salt spray testing at 35°C, conducted in accordance with ASTMB-117. The respective panels were then rated in accordance with ASTMD 1654-61 by measuring the average failure of the paint film from the scribe and recording this failure in inches. The corrosion test results are illustrated in Table 12. The panels treated with the zirconium rinse solutions showed superior corrosion resistance compared to the deionized water rinsed panels and the chromic acid rinsed panels. The salt fog test results in Table 12 are the averages of results of four tests.

TABLE 12

| Final Rinse Treatment | pH | Average Scribe Failure in Inches |
|---|---|---|
| Control — Deionized Water | 6.0 | 2/32 |
| Control — Chromic Acid Solution | 3.5 | 1/32 |
| Ammonium Zirconium Citrate | 5.9 | 1/64 |
| Ammonium Zirconium Tartrate | 6.0 | 1/64 |
| Ammonium Zirconium Gluconate | 7.3 | 1/64 |
| Zirconium Ethylenediamine tetraaccuate | 6.7 | 1/64 |

EXAMPLE 13

Four inches by six inches cold rolled steel test panels were employed in this procedure. The panels were cleaned, rinsed with water, and then subjected to a conventional zinc phosphate coating solution producing a zinc phosphate coating on their surfaces.

One set of control panels was rinsed with deionized water. Another set of control panels was rinsed with chromic acid solution having a hexavalent chromium concentration of 0.3 grams/liter, followed by a deionized water rinse. A third set of test panels was treated with a rinse solution consisting of 0.6 grams/liter of zirconium acetate so as to impart a concentration of 0.3 grams/liter of zirconium in the solution, expressed as $ZrO_2$. The pH of the zirconium rinse solution was measured at 4.6. The panels were rinsed with deionized water after their treatment with the zirconium rinse solution.

The panels were treated in the respective rinses by immersing them in the aqueous solutin for solution 30 seconds at room temperature. After each set of panels was subjected to a deionized water rinse, they were dried in an oven for five minutes at 350°F. The panels were then painted electrophoretically with a polyacrylic based paint system for 90 seconds at a temperature of 75°F and with a voltage of 185 volts. The painted surfaces were cured at 350°F for 30 minutes.

The painted panels were scribed diagonally so that base metal was exposed. The panels were then subjected to a 5% salt fog corrosion test at 35°C, conducted in accordance with ASTMB-117. Following 336 hours of salt spray exposure, the painted surfaces were examined for corrosion failure. The panels were rated in accordance with ASTMD 1654-61 by measuring the average failure of the paint film from the scribe. The results are shown in Table 13. The results in Table 13 are the averages of results of four tests.

TABLE 13

| Final Rinse Treatment | Average Scribe Failure in Inches |
|---|---|
| Deionized Water Rinse | 4/32 |
| Chromic Acid Based Rinse Followed by Deionized Water Rinse | 1/32 |
| Zirconium Acetate Rinse Solution Followed by Deionized Water Rinse | 1/64 |

Table 13 illustrates the superior corrosion resistance displayed by the panels rinsed with the zirconium rinse solution over those control panels rinsed with chromic acid and deionized water.

EXAMPLE 14

Four inch by six inch cold rolled steel test panels were employed in this procedure. The panels were cleaned, rinsed with water, and then subjected to a conventional prepaint processing step which provided a zinc phosphate conversion coating on their surfaces.

A set of control panels was then rinsed with water. Another set of panels was rinsed with the zirconium rinse solution prepared as described in Example 5. A third set of panels was rinsed with the zirconium rinse solution prepared as in Example 6.

All panels were immersed in the respective rinse solutions for 1 minute at room temperature, allowed to air-dry, and were oven baked for 5 minutes at 200°F. All panels were then painted with two coats of an asphaltum-based baking enamel, and the painted surfaces were cured at 450°F. for 45 minutes.

The painted panels were scribed diagonally so that base metal was exposed. The panels were then subjected to a 5% salt fog test at 35°C, conducted in accordance with ASTMB-117.

After a 264 hour exposure period, the panels were rated in accordance with ASTMD 1654-61, by inspecting the paint loss and measuring the average failure of the paint film from the scribe. The corrosion failure results are listed in Table 14. The performance of the panels rinsed with the respective zirconium rinse solutions was better than the controls rinsed with water.

TABLE 14

| Final Rinse Treatment | pH | Average Scribe Failure in Inches |
|---|---|---|
| Control — Water Rinse and no Further Treatment | 6.9 | 4/32 |
| Zirconium Rinse (as prepared in Rinse Example 5) | 5.5 | 2/32 |
| Zirconium Rinse (as prepared in Example 6) | 5.9 | 3/32 |

I claim:

1. As a composition of matter suitable for rinsing metal surfaces subsequent a conversion coating, an aqueous solution comprising:

1. a water soluble zirconium salt including at least one member selected from the group consisting of zirconium carboxylate, the alkali metal and ammonium salts of fluozirconate, the alkali metal and ammonium salts of a zirconium hydroxycarboxylate, and the zirconium salt of ethylendiaminetetraacetate, wherein said zirconium moiety is present in said solution as the tetravalent ion in a concentration of from about .05 grams to about 3 grams per liter, expressed as zirconium dioxide ($ZrO_2$) and,
2. at least one member selected from the group consisting of gluconic acid and citric acid and salts thereof in an amount sufficient to solubilize trace minerals present, if any;

said solution being rendered to a pH of between about 3 to about 8.5.

2. The composition of claim 1 wherein said zirconium carboxylate is selected from the group consisting of zirconium acetate and zirconium oxalate.

3. The composition of claim 1 wherein said zirconium hydroxycarboxylate is selected from the group consisting of zirconium glycolate, zirconium lactate, zirconium mandelate, zirconium citrate, zirconium gluconate, and zirconium tartrate.

* * * * *